US008253681B2

(12) United States Patent
Hayashi et al.

(10) Patent No.: US 8,253,681 B2
(45) Date of Patent: Aug. 28, 2012

(54) LIGHT SOURCE DEVICE, A DISPLAY DEVICE AND A TELEVISION RECEIVER

(75) Inventors: Keiji Hayashi, Kameyama (JP); Kentaro Kamada, Kameyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 921 days.

(21) Appl. No.: 12/087,097

(22) PCT Filed: Oct. 3, 2006

(86) PCT No.: PCT/JP2006/319797

§ 371 (c)(1),
(2), (4) Date: Jul. 21, 2008

(87) PCT Pub. No.: WO2007/074568

PCT Pub. Date: Jul. 5, 2007

(65) Prior Publication Data

US 2009/0140657 A1 Jun. 4, 2009

(30) Foreign Application Priority Data

Dec. 29, 2005 (JP) ..... 2005-380550

(51) Int. Cl.
*G09G 3/36* (2006.01)

(52) U.S. Cl. ..... 345/102; 345/212; 345/207; 345/82; 345/76

(58) Field of Classification Search ..... 345/204, 345/207, 690, 211, 212, 213, 214, 76, 77, 345/81, 82, 84, 88, 90, 102
See application file for complete search history.

(56) References Cited

U.S. PATENT DOCUMENTS

| | | | | |
|---|---|---|---|---|
| 7,052,138 | B2 | 5/2006 | Matsui | |
| 7,242,384 | B2 * | 7/2007 | Yamamoto et al. | 345/102 |
| 7,595,784 | B2 * | 9/2009 | Yamamoto et al. | 345/102 |
| 7,990,352 | B2 * | 8/2011 | Hu et al. | 345/88 |
| 2003/0058202 | A1 * | 3/2003 | Evanicky et al. | 345/82 |
| 2005/0058450 | A1 | 3/2005 | Yamamoto et al. | |
| 2006/0092182 | A1 * | 5/2006 | Diefenbaugh et al. | 345/690 |
| 2007/0069998 | A1 * | 3/2007 | Naugler et al. | 345/81 |

FOREIGN PATENT DOCUMENTS

| | | |
|---|---|---|
| JP | 09-197373 | 7/1997 |
| JP | 2001-066569 | 3/2001 |
| JP | 2003-274646 | 9/2003 |
| JP | 2004-184852 | 7/2004 |
| JP | 2005-071702 | 3/2005 |
| JP | 2005-091526 | 4/2005 |

* cited by examiner

*Primary Examiner* — Tuyet Thi Vo

(74) *Attorney, Agent, or Firm* — Harness, Dickey & Pierce, PLC

(57) ABSTRACT

A light source device and a display device are disclosed of which high display quality can be maintained by correcting luminance or a color tone without making a user feel strangeness or inconvenience. A light source device is disclosed in at least one embodiment, including light source blocks each of which has red-color light-emitting diodes, green-color light-emitting diodes and blue-color light-emitting diodes and is capable of independently adjusting luminance of the three color diodes, a photo-receiving mechanism arranged to photo-receive light, and a correcting operation control mechanism arranged to calculate correction amounts of the luminance of the light sources in each of the blocks based on photo-receiving amounts of the photo-received light in order to maintain uniform luminance or a uniform color tone among the blocks, wherein the mechanism controls the mechanism to photo-receive the light when a termination operation of the light source device is performed.

20 Claims, 13 Drawing Sheets

391

(Conventional Art)

LIGHT SOURCE DEVICE, A DISPLAY DEVICE AND A TELEVISION RECEIVER

BACKGROUND OF THE INVENTION

1. Field of the Invention

The present invention relates to a light source device, a display device and a television receiver, and more specifically relates to a light source device for a display device or for a television receiver such that luminance and/or a color tone of light sources can be corrected, a display device having the light source device, and a television receiver having the display device.

2. Description of the Related Art

A display device having a non-self-emissive display panel such as a translucent liquid crystal panel sometimes includes a light source device placed behind the liquid crystal display panel or on a lateral side of the liquid crystal display panel. This type of display device is arranged so that light emitted from the light source device passes through the display panel from behind to its front side, and makes an image displayed visible on the front side of the display panel.

As light sources incorporated in such a light source device, fluorescent tubes such as hot cathode tubes and cold cathode tubes are widely used, and nowadays light-emitting diodes (LEDs) are also used.

FIG. 13 is an exploded perspective view schematically illustrating the structure of a conventional light source device in which light-emitting diodes are used as light sources. In a light source device 9 in FIG. 13, light source blocks 91 each having the shape of a plate are placed on a front surface of a chassis 92. Each of the light source blocks 91 contains light-emitting diodes 93 each of which includes a red-color light-emitting diode, a green-color light-emitting diode and a blue-color light-emitting diode. The light source blocks 91 are capable of emitting white light by mixing red light, green light and blue light which are emitted respectively from the red-color, green-color and blue-color light-emitting diodes.

Incidentally, light-emitting diodes sometimes have individual differences in properties such as luminance and a color tone. Therefore, the red-color, green-color and blue-color light-emitting diodes included in the light-emitting diodes are placed at the time of manufacture of the light source device so that the luminance and/or the color tone become uniform within each of the light source blocks. However, the luminance and/or the color tone sometimes differ from one light source block to another light source block. In some cases, the luminance and/or the color tone gradually have differences due to change over time in properties of the light-emitting diodes even though they do not differ from one light source block to another light source block at the time of manufacture or shipment of the light source device. Those differences in the luminance and/or the color tone among the light source blocks in the light source device cause irregular luminance and/or irregular color, which could worsen the display quality of the light source device or the display device incorporating the light source device.

In order to prevent the irregular luminance and/or the irregular color caused by the differences in the properties of the light-emitting diodes, various proposals have been made such as inclusion of a mechanism for correcting the luminance and/or the color tone in accordance with the differences in the properties of the light-emitting diodes in the light source device or the display device.

As a prior art literature relating to the present invention, Japanese Patent Application Unexamined Publications Nos. 2003-274646 and Hei 09-197373 are cited. As a manner of adjusting display colors and brightness on a screen of a display device including LEDs as light sources, a technique disclosed in Japanese Patent Application Unexamined Publication No. 2004-184852 is cited. However, a manner of improving uniformity within the screen is not disclosed.

The correction of the luminance and/or the color tone among the light source blocks is made by making the color light-emitting diodes of each color emit light which are included in the light-emitting diodes contained in the light source block subjected to the correction, measuring the luminance of the color light-emitting diodes of each color, and calculating correction amounts of the luminance of the color light-emitting diodes of each color. Accordingly, the measurement needs to be performed the number of times which is computed by multiplying the number of the light source blocks by the number of the colors of the color light-emitting diodes included in one light-emitting diode, which increases the total time required for the measurement of the luminance. Especially, accompanied by recent increases in the size of a liquid crystal display panel, the number of the light source blocks incorporated in the light source device goes up, which further increases the total time required for the measurement of the luminance.

In order to make the correction of the luminance and/or the color tone with accuracy, it is preferable to perform the measurement of the luminance in a state similar to an actual usage state of the display device or the light source device. However, the display device cannot make regular display during the measurement of the luminance of the color light-emitting diodes. This is because if the measurement of the luminance is performed during the use of the display device, a user could feel strangeness with an image displayed on the display panel. Meanwhile, if it is arranged that a user performs the operation for the correction of the luminance and/or the color tone among the light source blocks, the user could feel inconvenience in using the display device.

SUMMARY OF THE INVENTION

In order to overcome the problems described above, preferred embodiments of the present invention provide a light source device such that balance of luminance and/or balance of a color tone can be maintained among light source blocks, a display device having the light source device and a television receiver having the display device, a light source device such that luminance and/or a color tone can be corrected among light source blocks without making a user feel strangeness or inconvenience, a display device having the light source device and a television receiver having the display device, or a light source device such that balance of luminance and/or balance of a color tone can be corrected among light source blocks with accuracy, a display device having the light source device and a television receiver having the display device.

According to a preferred embodiment of the present invention, a light source device includes a plurality of light source blocks each of which has light sources arranged to emit light within different wave length ranges which can be adjusted independently, a photo-receiving mechanism arranged to photo-receive the light emitted from the light sources of the light source blocks, and a correcting operation control mechanism, wherein when a termination operation of the light source device is performed, the correcting operation control mechanism controls the light sources of the light source blocks to emit the light and the photo-receiving mechanism to photo-receive the light, and based on photo-receiving amounts of the light photo-received by the photo-receiving mechanism, calculates correction amounts of luminance of the light sources in each of the light source blocks, which are necessary to maintain luminance and/or a color tone to be uniform among the light source blocks.

It is preferable that the light source device further includes a timer mechanism arranged to time an operating time of the light source device, wherein when a cumulative operating time of the light source device exceeds a preset time, the correcting operation control mechanism controls the light sources of the light source blocks to emit the light and the photo-receiving mechanism to photo-receive the light, and based on the photo-receiving amounts of the light photo-received by the photo-receiving mechanism, calculates the correction amounts of the luminance of the light sources in each of the light source blocks, which are necessary to maintain the luminance and/or the color tone to be uniform among the light source blocks.

It is preferable that the light source device further includes a timer mechanism arranged to time an operating time of the light source device, wherein when a continuous operating time of one operation of the light source device immediately before the termination operation of the light source device is performed exceeds a preset time, the correcting operation control mechanism controls the light sources of the light source blocks to emit the light and the photo-receiving mechanism to photo-receive the light, and based on the photo-receiving amounts of the light photo-received by the photo-receiving mechanism, calculates the correction amounts of the luminance of the light sources in each of the light source blocks, which are necessary to maintain the luminance and/or the color tone to be uniform among the light source blocks.

It is preferable that the light source device further includes a dimmer controlling member capable of controlling transmittance of the light, which is placed at a position on an optical path of the light between a point where the light is emitted from the light sources and a point where the light exits to the outside, wherein the dimmer controlling member is brought to an impermeable state during the calculation of the correction amounts of the luminance of the light sources in each of the light source blocks.

The dimmer controlling means is preferably a translucent display element.

According to another preferred embodiment of the present invention, a display device includes a display panel and the light source device according to any one of claims 1 to 5.

According to another preferred embodiment of the present invention, a display device includes a display panel, the light source device according to any one of claims 1 to 3, and a dimmer controlling member placed at a position on an optical path of the light between a point where the light is emitted from the light sources and a point where the light exits to the outside, which is brought to an impermeable state during the calculation of the correction amounts of the luminance of the light sources for each of the light source blocks.

According to another preferred embodiment of the present invention, a television receiver includes any one of the above-described light sources, and either one of the above-described display device.

According to the preferred embodiments of the present invention, since the luminance of the light sources which emit the light within the different wave length ranges is measured for each of the light source blocks when the termination operation of the light source device is performed, the measurement of the luminance is not performed during the use of the light source device, so that the user does not feel strangeness. In addition, the user does not need to perform the operation for correction of the luminance and/or the color tone among the light source blocks, the user does not feel inconvenience in using the light source device.

When the light source device is arranged such that the correction amounts are calculated at regular time intervals every time the cumulative operating time exceeds the preset time, the balance of the luminance and/or the balance of the color tone can be maintained among the light source blocks, which allows high-definition display to be maintained even if the light source device is used over a long period of time.

When the light source device is arranged such that the correction amounts are calculated when the continuous operating time of one operation of the light source device immediately before the termination operation of the light source device is performed exceeds the preset time, the correction amounts can be calculated in a state where the interior temperature of the display device is the same or close to a temperature at the time of use, which allows the correction with great accuracy to be performed and high-definition display to be maintained.

In addition, when the light source device is arranged such that the dimmer controlling member is brought to the impermeable state during the calculation of the correction amounts of the luminance of the light sources for each of the light source blocks, the light emitted from the light source blocks does not exit to the outside during the calculation, so that the user does not feel strangeness with the operation of the light source device or the display device.

Other features, elements, characteristics and advantages of the present invention will become more apparent from the following detailed description of preferred embodiments with reference to the attached drawings.

DESCRIPTION OF PREFERRED EMBODIMENTS

A detailed description of preferred embodiments of the present invention will now be given with reference to the accompanying drawings.

Figure 1A:
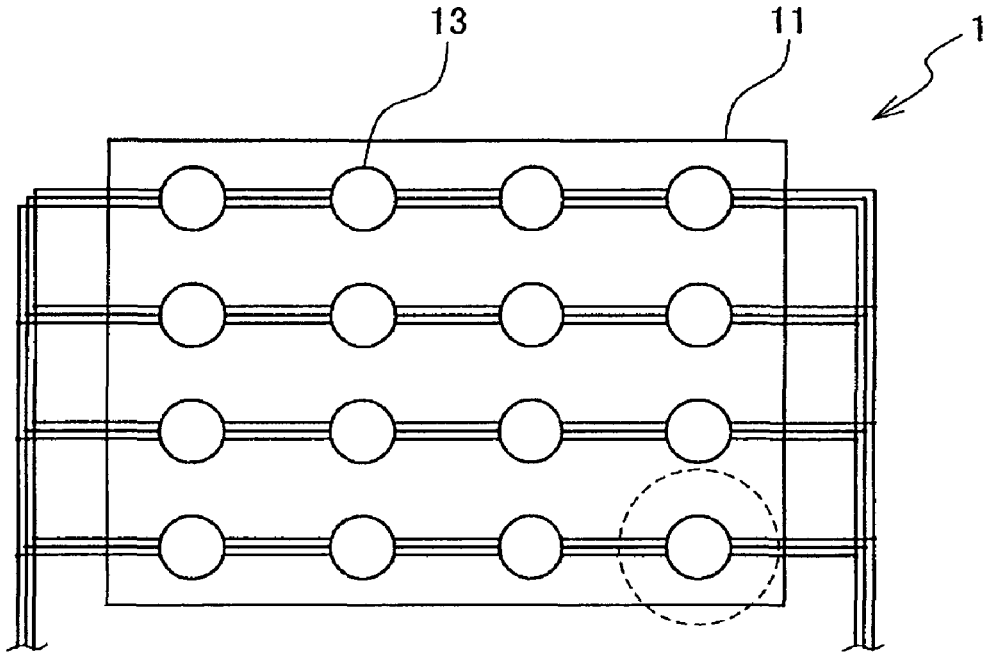
FIGS. 1A and 1B are plan views schematically illustrating the configuration of a light source block used in a light source device according to a first preferred embodiment of the present invention.
Figure 1B:
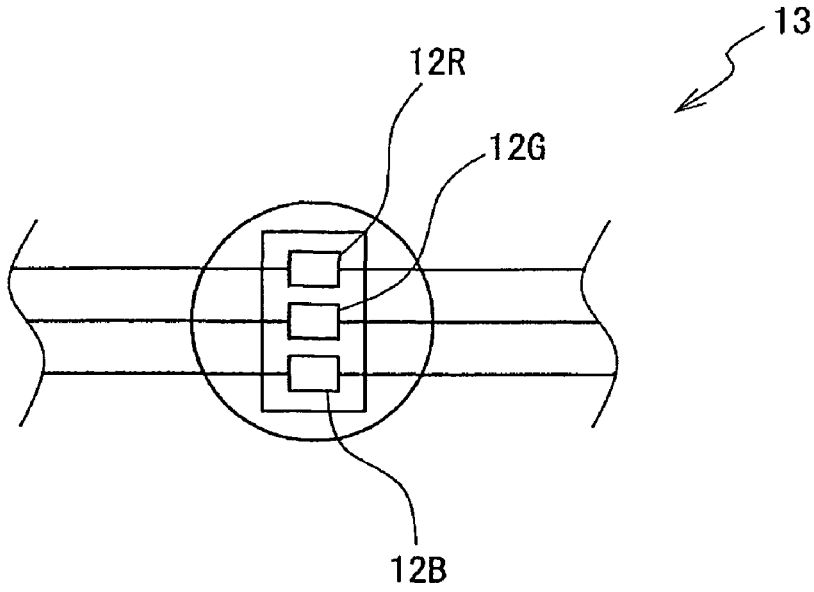

FIG. 1A is a plan view schematically illustrating the configuration of a light source block used in a light source device according to a first preferred embodiment of the present invention. A light source block 1 is a light source in the shape of a sheet which is capable of emitting white light. The light source block 1 includes packaged light-emitting diodes 13 arranged in a matrix on a substrate 11 substantially in the shape of a square. FIG. 1B is a plan view schematically illustrating the configuration of the packaged light-emitting diode 13. As shown in FIG. 1B, the packaged light-emitting diode 13 includes a red-color light-emitting diode 12R, a green-color light-emitting diode 12G and a blue-color light-emitting diode 12B which are placed close to one another, and is encapsulated in a transparent resin material or other material. The packaged light-emitting diode 13 is capable of emitting the white light by mixing red light, green light and blue light which are emitted respectively from the red-color, green-color and blue-color light-emitting diodes 12R, 12G and 12B.

As shown in FIGS. 1A and 1B, circuits arranged to individually drive the red-color light-emitting diode 12R, the green-color light-emitting diode 12G and the blue-color light-emitting diode 12B encapsulated in the packaged light-emitting diode 13 are provided independently of one another. By this configuration, turning on and out and adjustment of luminance can be performed individually for the red-color light-emitting diodes 12R, for the green-color light-emitting diodes 12G, and for the blue-color light-emitting diodes 12B in each of the light source blocks 1. Accordingly, by individually adjusting power to be supplied to the red-color light-emitting diodes 12R, power to be supplied to the green-color light-emitting diodes 12G, and power to be supplied to the blue-color light-emitting diodes 12B, luminance and/or a color tone can be adjusted as a whole within each of the light source blocks 1. In addition, by individually adjusting power to be supplied to the red-color light-emitting diodes 12R, power to be supplied to the green-color light-emitting diodes 12G, and power to be supplied to the blue-color light-emitting diodes 12B in the light source blocks 1, luminance and/or a color tone can be corrected to be uniform among the light source blocks 1.

Figure 2:
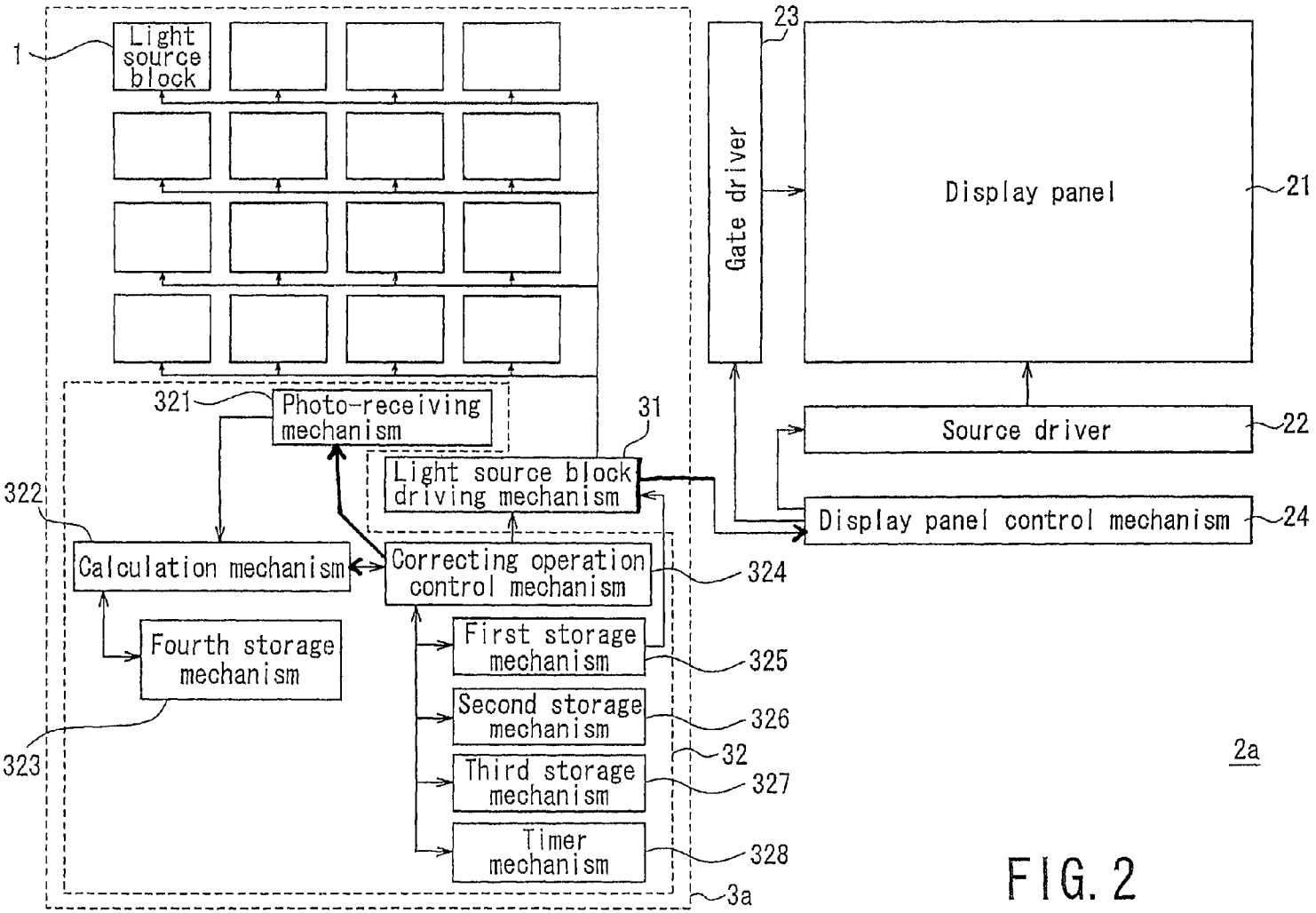
FIG. 2 is a block diagram schematically showing the configuration of a display device in which the light source device according to the first preferred embodiment of the present invention is incorporated.

FIG. 2 is a block diagram schematically showing the configuration of the light source device and a display device according to the first preferred embodiment of the present invention. A display device 2*a* according to the first preferred embodiment of the present invention includes a light source device 3*a*, a display panel 21 arranged to display an image, source drivers 22 and gate drivers 23 which drive the display panel 21, and a display panel control mechanism 24 arranged to control the source drivers 22 and the gate drivers 23.

The light source device 3*a* incorporated in the display device 2*a* includes the light source blocks 1, a light source block driving mechanism 31 arranged to drive the light source blocks 1, and a correction mechanism 32 arranged to make and store correction data tables which are used for correction of the luminance and/or the color tone within each of the light source blocks 1.

The correction data table describes the extents to which the power to be supplied to the red-color light-emitting diodes 12R, the power to be supplied to the green-color light-emitting diodes 12G, and the power to be supplied to the blue-color light-emitting diodes 12B need to be individually corrected in order that the light source device 3*a* as a whole emits white light of uniform luminance and a uniform color tone.

The correction mechanism 32 includes a photo-receiving mechanism 321, a calculation mechanism 322, a fourth storage mechanism 323, a correcting operation control mechanism 324, a first storage mechanism 325, a second storage mechanism 326, a third storage mechanism 327, and a timer mechanism 328.

First, brief descriptions of the functions of the above-described constituent elements are provided. The photo-receiving mechanism 321 is arranged to photo-receive the light emitted from the red-color light-emitting diodes 12R, the light emitted from the green-color light-emitting diodes 12G and the light emitted from the blue-color light-emitting diodes 12B included in the light source blocks 1. The fourth storage mechanism 323 is arranged to store photo-receiving amounts of the light from the red-color light-emitting diodes 12R in the initial state, the light from the green-color light-emitting diodes 12G in the initial state, and the light from the blue-color light-emitting diodes 12B in the initial state in each of the light source blocks 1. The calculation mechanism 322 is arranged to calculate a ratio between present photo-receiving amounts of the light photo-received by the photo-receiving mechanism 321 and the photo-receiving amounts of the light in the initial state which are stored in the fourth storage mechanism 323.

In the present preferred embodiment of the present invention, the "initial state" defines the state of the light source device 3*a* in which the balance of the luminance and the balance of the color tone are maintained among the light source blocks 1 and the light source device 3*a* as a whole can emit white light of uniform luminance and a uniform color tone. Hereinafter, the photo-receiving amount of the light in the initial state is referred to as the "initial photo-receiving amount".

The correcting operation control mechanism 324 controls the photo-receiving mechanism 321 and the calculation mechanism 322, and makes the correction data tables used for the correction of the luminance of the red-color light-emitting diodes 12R, the luminance of the green-color light-emitting diodes 12G and the luminance of the blue-color light-emitting diodes 12B in each of the light source blocks 1. The second storage mechanism 326 is capable of storing a variety of parameters required in making the correction data tables. The first storage mechanism 325 is capable of storing the made correction data tables. The timer mechanism 328 is capable of timing operating times of the light source device 3*a* or the display device 2*a*.

Next, detailed descriptions of the above-described constituent elements and members are provided.

The photo-receiving mechanism 321 photo-receives the light emitted from the red-color light-emitting diodes 12R, the light emitted from the green-color light-emitting diodes 12G and the light emitted from the blue-color light-emitting diodes 12B in each of the light source blocks 1, and produces signals in accordance with the photo-receiving amounts of the light. For the photo-receiving mechanism 321, a variety of photo-receiving elements such as a phototransistor and a photodiode are used.

The fourth storage mechanism 323 is capable of storing the photo-receiving amount of the light from the red-color light-emitting diodes 12R which is photo-received by the photo-receiving mechanism 321, the photo-receiving amount of the light from the green-color light-emitting diodes 12G which is photo-received by the photo-receiving mechanism 321, and the photo-receiving amount of the light of the blue-color light-emitting diodes 12B which is photo-received by the photo-receiving mechanism 321 for each of the light source blocks 1 at the time when the light source device 3*a* is in the initial state. To be more specific, the fourth storage mechanism 323 is capable of storing data tables including data on the photo-receiving amounts the number of which is computed by multiplying the total number of light source blocks 1 included in the light source device 3*a* by the total number of colors of the color light-emitting diodes (in the present embodiment of the present invention, the number is three; red, green and blue).

The calculation mechanism 322 calculates a ratio between the photo-receiving amount of the light emitted from the color light-emitting diodes of one given color included in one given light source block 1, and the initial photo-receiving amount of the light from the same color light-emitting diodes which is stored in the fourth storage mechanism 323. Hereinafter, the ratio between these photo-receiving amounts is referred to simply as the "photo-receiving amount ratio". The photo-receiving amount ratio indicates the extent to which the photo-receiving amount of the light from the color light-emitting diodes of one given color in one given light source block 1 varies compared with the photo-receiving amount of the light from the same color light-emitting diodes in the initial state.

While controlling the photo-receiving mechanism 321 and the calculation mechanism 322, the correcting operation control mechanism 324 makes the correction data tables used for the correction of the luminance of the red-color light-emitting diodes 12R, the luminance of the green-color light-emitting diodes 12G and the luminance of the blue-color light-emitting diodes 12B placed in each of the light source blocks 1 based on the calculated photo-receiving amount ratios of the light emitted from the red-color light-emitting diodes 12R, the light emitted from the green-color light-emitting diodes 12G and the light emitted from the blue-color light-emitting diodes 12B when predetermined conditions to be described later are met.

The first storage mechanism 325 is capable of storing the correction data tables which are made by the correcting operation control mechanism 324. The correction data tables stored in the first storage mechanism 325 can be read therefrom by the light source block driving mechanism 31.

The second storage mechanism 326 is capable of storing data required in calculating the luminance of the red-color light-emitting diodes 12R, the luminance of the green-color light-emitting diodes 12G and the luminance of the blue-color light-emitting diodes 12B in each of the light source blocks 1 based on the photo-receiving amounts measured by the photo-receiving mechanism 321.

The data required in the calculation is described. First, it is necessary to obtain with accuracy the actual luminance of the red-color light-emitting diodes 12R, the actual luminance of the green-color light-emitting diodes 12G and the actual luminance of the blue-color light-emitting diodes 12B in each of the light source blocks 1 in order to correct the luminance and the color tone in the light source device 3*a* so as to be uniform. However, even though the obtained luminance of the red-color light-emitting diodes 12R, the obtained luminance of the green-color light-emitting diodes 12G, and the obtained luminance of the blue-color light-emitting diodes 12B are uniform among the light source blocks 1, if the photo-receiving mechanism 321 has different distances from or different angles with respect to the light source blocks 1, the photo-receiving amounts of the light photo-received by the photo-receiving mechanism 321 differ among the light source blocks 1 in accordance with the distances or the angles between the photo-receiving mechanism 321 and the light source blocks 1. Hence, it is necessary to take influences exerted by the differences in distance or angle between the photo-receiving mechanism 321 and the light source blocks 1 into consideration when calculating the luminance of the red-color light-emitting diodes 12R, the luminance of the green-color light-emitting diodes 12G and the luminance of the blue-color light-emitting diodes 12B in each of the light source blocks 1.

Accordingly, the second storage mechanism 326 stores the variety of parameters required in calculating the actual luminance of the red-color light-emitting diodes 12R, the actual luminance of the green-color light-emitting diodes 12G, and the actual luminance of the blue-color light-emitting diodes 12B in each of the light source blocks 1. The parameters stored in the second storage mechanism 326 can be read therefrom by the correcting operation control mechanism 324.

The timer mechanism 328 is capable of timing and storing a cumulative operating time and every continuous operating time of the light source device 3*a* or the display device 2*a*. The cumulative operating time can be reset to zero by an initialization operation. Results of the timing of the times by the timer mechanism 328 can be read therefrom by the correcting operation control mechanism 324.

The third storage mechanism 327 is capable of storing a time interval to make the correction data tables, and a length of time from when the interior temperature of the light source device 3*a* or the display device 2*a* starts to go up immediately after the initiation of the use and it reaches a substantially steady state.

It is preferable for the correction data tables to be made at given regular intervals in order that the light source device 3*a* maintains the uniform luminance and the uniform color tone. Hence, in the present preferred embodiment of the present invention, the correction mechanism 32 of the light source device 3*a* makes the correction data tables every time the cumulative operating time reaches a preset length of time. The third storage mechanism 327 stores a set value of the preset length of time as the time interval to make the correction data tables.

The time interval to make the correction data tables is set appropriately in consideration of a variety of conditions. To be more specific, the time interval is preferably set so that the correction data tables are made every time the cumulative operating time of one-hundred hours has elapsed.

A light-emitting diode has a luminance property which sometimes varies with a temperature. Accordingly, it is preferable that the luminance of the red-color light-emitting diodes 12R, the luminance of the green-color light-emitting diodes 12G, and the luminance of the blue-color light-emitting diodes 12B are measured under the condition that the temperature is close as much as possible to a temperature at the time of actual use.

It is assumed that the interior temperature of the light source 3*a* or the display device 2*a* starts to go up immediately after the initiation of the use and reaches the substantially steady state after a lapse of a given time. Accordingly, such a criterion for judging whether or not the correction data tables are to be made is possible that the correction data tables are made when the interior temperature of the display device 2*a* reaches the steady state. In order to make such a judgment, the third storage mechanism 327 stores the set value of the length of time from when the interior temperature of the light source device 3*a* or the display device 2*a* starts to go up immediately after the initiation of the use and it reaches the substantially steady state. The set value of the length of time stored in the third storage mechanism 327 can be read therefrom by the correcting operation control mechanism 324.

The light source block driving mechanism 31 drives the red-color light-emitting diodes 12R, the green-color light-emitting diodes 12G and the blue-color light-emitting diodes 12B placed in each of the light source blocks 1. For example, the light source block driving mechanism 31 can dynamically control the luminance in each of the light source blocks 1 based on signals from the display panel control mechanism 24 to be described later, in other words, according to changes in luminance tone of an image displayed on the display panel 21. For the light source block driving mechanism 31, a variety of known constant-current power supply circuits may be used.

The light source block driving mechanism 31 refers to the correction data tables stored in the first storage mechanism 325 before supplying power to the red-color light-emitting diodes 12R, the green-color light-emitting diodes 12G and the blue-color light-emitting diodes 12B in each of the light source blocks 1. Then, the light source block driving mechanism 31 supplies power corrected based on the correction data tables to the red-color light-emitting diodes 12R, the green-color light-emitting diodes 12G and the blue-color light-emitting diodes 12B in each of the light source blocks 1 so as to drive them.

For the display panel 21, a variety of known liquid crystal display panels such as a generally-used active matrix type liquid crystal display panel may be used. As the source drivers 22 and the gate drivers 23 which drive the display panel 21, generally-used conventional source drivers and gate drivers may be used. Accordingly, detailed descriptions thereof are omitted.

The display panel control mechanism 24 produces signals to control the source drivers 22 and the gate drivers 23 based on image signals and other signals inputted from the outside. As the display panel control mechanism 24, a generally-used conventional display panel control mechanism may be used.

Figure 3:
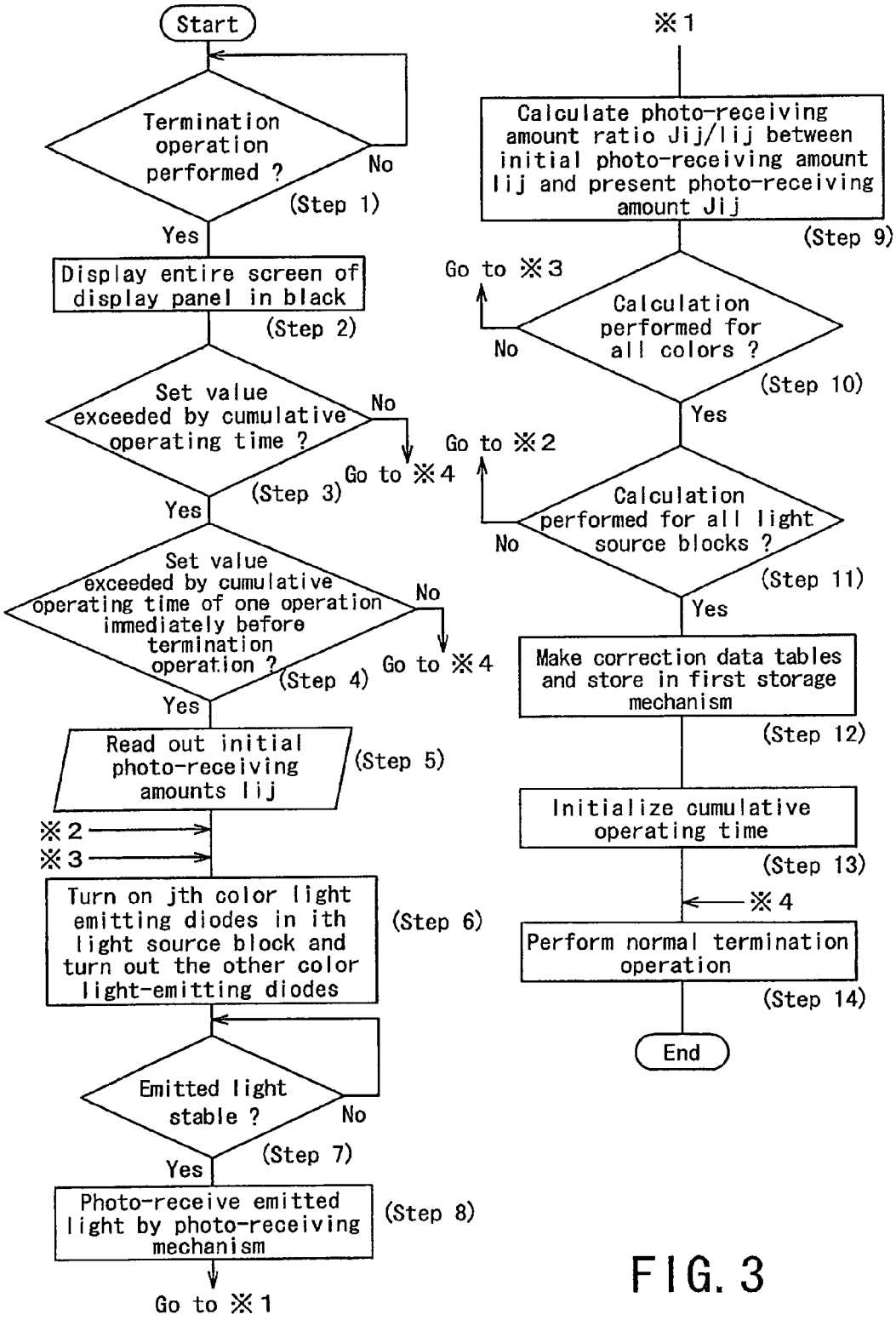
FIG. 3 is a flow chart showing the operation for correction of luminance and a color tone in the light source device incorporated in the display device according to the first preferred embodiment of the present invention.

Next, a description of the operation for the correction of the luminance and the color tone in the display device 2*a* having the above-described configuration, in other words, a description of a process of making the correction data tables, is provided. FIG. 3 is a flow chart showing the process of making the correction data tables.

The correcting operation control mechanism 324 judges whether or not a user has performed a termination operation of the display device 2*a* (Step 1). The termination operation of the display device 2*a* defines an operation to terminate display of the image on the display panel 21, or a series of operations including such an operation. Examples of the termination operation include an operation to turn off a power switch of the display device 2*a*, and an operation to switch the display device 2*a* to a standby mode.

When the termination operation is performed, the entire screen of the display panel 21 is switched to be displayed in black (Step 2). The display in black defines display in the substantially lowest luminance tone. After the entire screen of the display panel 21 is switched to be displayed in black, the light from the color light-emitting diodes 12R, 12G and 12B in the light source blocks 1 can hardly pass through the display panel 21. Accordingly, the user visually perceives the display in a state where the light source device 3*a* is turned out or a similar state.

Next, the correcting operation control mechanism 324 reads from the timer mechanism 328 the result of the timing of the cumulative operating time of the display device 2*a* after the last making of the correction data tables. Then, the correcting operation control mechanism 324 judges whether or not the cumulative operating time exceeds a set value (Step 3). The set value in Step 3 is the length of time which is stored in the third storage mechanism 327 as the time interval to make the correction data tables.

When the cumulative operating time of the display device 2*a* exceeds the set value, the correcting operation control mechanism 324 reads from the timer mechanism 328 a continuous operating time of one operation of the display device 2*a* immediately before the termination operation is performed. Then, the correcting operation control mechanism 324 judges whether or not the read continuous operating time exceeds a set value (Step 4). The set value in Step 4 is the length of time which is stored in the third storage mechanism 327 as the length of time from when the interior temperature of the display device 2*a* starts to go up immediately after the initiation of the use and it reaches the substantially steady state.

When the cumulative operating time after the last making of the correction data tables does not exceed the set value, or when the continuous operating time of one operation immediately before the termination operation is performed does not exceed the set value, the correction data tables are not made and a normal termination operation is performed (Step 14).

When both of the cumulative operating time after the last making of the correction data tables and the continuous operating time of one operation immediately before the termination operation is performed exceed the respective set values, the correction mechanism 32 renews the correction data tables (the process goes to Step 5).

First, the calculation mechanism 322 reads from the fourth storage mechanism 323 initial photo-receiving amounts $I_{ij}$ of the light from the red-color light-emitting diodes 12R, the light from the green-color light-emitting diodes 12G and the light from the blue-color light-emitting diodes 12B in each of the light source blocks 1 (Step 5). Besides, a suffix i added to the initial photo-receiving amount I indicates the ith light source block, where i is a number from 1 up to the total number of light source blocks. In addition, a suffix j added to the initial photo-receiving amount I indicates the jth color light-emitting diodes, where j is a number from 1 up to the total number of colors of the color light-emitting diodes (in the present preferred embodiment of the present invention, the number of colors is three). For example, j=1, j=2, and j=3 respectively indicate red, green, and blue. Hereinafter, the suffixes i and j are used so as to indicate the same as these.

Next, the jth color light-emitting diodes in the ith light source block 1 are turned on and the other color light-emitting diodes are turned out (Step 6). Then, there is a wait until the state of the emitted light from the jth color light-emitting diodes which are turned on becomes stable (Step 7). To be more specific, the wait is a predetermined time, e.g., 50 ms, after the jth color light-emitting diodes start emitting the light.

After the state of the emitted light from the jth color light-emitting diodes which are turned on becomes stable, the photo-receiving mechanism 321 photo-receives the light emitted from the jth color light-emitting diodes (Step 8).

The calculation mechanism 322 calculates a ratio $J_{ij}/I_{ij}$ between a present photo-receiving amount $J_{ij}$ measured in the previous step and the initial photo-receiving amount $I_{ij}$ read from the fourth storage mechanism 323 (i.e., a photo-receiving amount ratio) (Step 9).

Then, photo-receiving amount ratios $J_{ij}/I_{ij}$ are calculated for the red-color light-emitting diodes 12R, the green-color light-emitting diodes 12G and the blue color light-emitting diodes 12B in the ith light source block 1 (Step 10). Further, such calculation to obtain the photo-receiving amount ratios $J_{ij}/I_{ij}$ is performed for all of the light source blocks 1 (Step 11). In other words, the calculation to obtain the photo-receiving amount ratios $J_{ij}/I_{ij}$ is repeated until all of the numbers from 1 up to the total number of light source blocks 1 are assigned to the suffix i, and all of the numbers from 1 up to the number of colors of the color light-emitting diodes are assigned to the suffix j.

In this manner, the photo-receiving amount ratios $J_{ij}/I_{ij}$ for the red-color light-emitting diodes 12R, the green-color light-emitting diodes 12G and the blue color light-emitting diodes 12B in all of the light source blocks 1 are calculated, and data tables in which the photo-receiving amount ratios $J_{ij}/I_{ij}$ are described are made. The data tables have data the number of which is computed by multiplying the total number of light source blocks 1 by the number of colors of the color light-emitting diodes.

Then, the correcting operation control mechanism 324 makes correction data tables based on the made data tables of the photo-receiving amount ratios $J_{ij}/I_{ij}$ and the variety of parameters stored in the second storage mechanism 326 (Step 12). As described above, described in the correction data table are the extents to which the power to be supplied to the red-color light-emitting diodes 12R, the power to be supplied to the green-color light-emitting diodes 12G, and the power to be supplied the blue-color light-emitting diodes 12B need to be individually corrected in order that the luminance and the color tone are made uniform among the light source blocks 1. After the correction data tables are made, the first storage mechanism 325 stores the made correction data tables (Step 12).

Next, the cumulative operating time timed by the timer mechanism 328 is initialized to be reset to zero (Step 13). Through the steps described above, the process of making the correction data tables is terminated.

Then, the normal termination operation is performed (Step 14). For example, the emission of the light by the red-color light-emitting diodes 12R, the emission of the light by the green-color light-emitting diodes 12G, and the emission of the light by the blue color light-emitting diodes 12B in all of the light source blocks 1 are stopped, and after a predetermined time has elapsed or after the interior temperature of the display device 2*a* falls below a predetermined temperature, a blower fan included in the display device 2*a* or the light source device 3*a* stops rotating.

In the subsequent operation of the display device 2*a*, the light source block driving mechanism 31 refers to the correction data tables stored in the first storage mechanism 325, and supplies power corrected based on the correction data tables to the red-color light-emitting diodes 12R, the green-color light-emitting diodes 12G and the blue-color light-emitting diodes 12B in each of the light source blocks 1 so as to drive them.

By this configuration, the measurement of the photo-receiving amounts of the light from the red-color light-emitting diodes 12R, the light from the green-color light-emitting diodes 12G and the light from the blue-color light-emitting diodes 12B in each of the light source blocks 1 is performed at the time when the display panel 21 does not need to display an image after the user performs the termination operation of the display device 2*a*. Accordingly, it is prevented that the user feels strangeness with the measurement operation for measuring the photo-receiving amounts. Especially by switching the display panel 21 to be displayed in black before the measurement is performed, the user does not notice the measurement being performed.

In addition, since the correction data tables are made automatically every time the preset cumulative operating time has elapsed, high display quality of the display device 2*a* can be maintained consistently. Further, since the correction data tables are made when the continuous operating time of one operation of the light source device 3*a* immediately before the termination operation is performed exceeds the preset time, the measurement of the luminance of the red-color light-emitting diodes 12R, the luminance of the green-color light-emitting diodes 12G and the luminance of the blue-color light-emitting diodes 12B can be performed in a state where the interior temperature of the display device 2*a* or the light source device 3*a* is close to a temperature at the time of actual use. Therefore, the correction data tables with great accuracy can be made.

Figure 4:
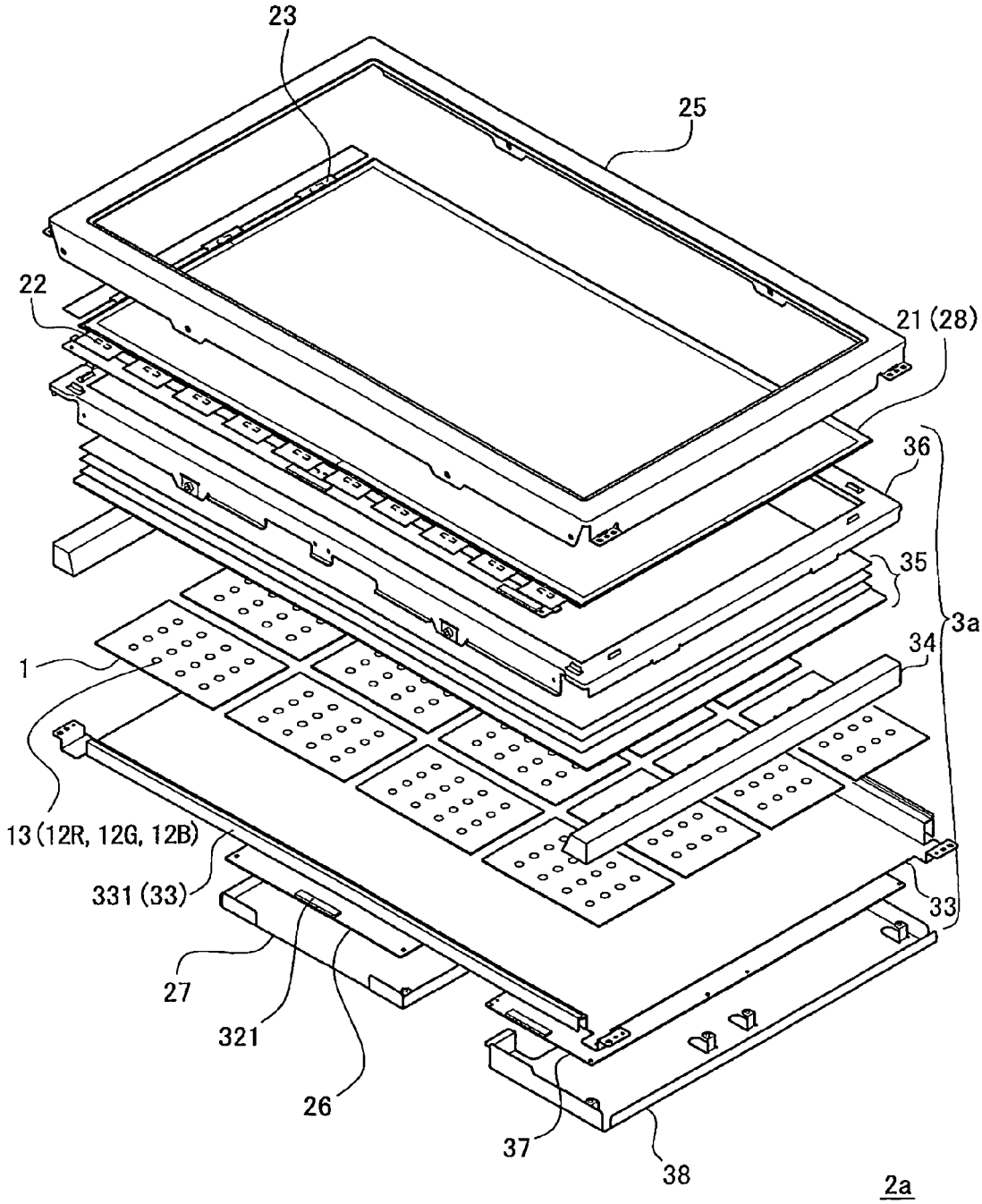
FIG. 4 is an exploded perspective view schematically illustrating the structure of the display device according to the first preferred embodiment of the present invention.

Next, descriptions of the structure of the light source device 3*a* according to the first preferred embodiment of the present invention, and the display device 2*a* in which the light source device 3*a* according to the first preferred embodiment of the present invention is incorporated (i.e., the display device according to the first preferred embodiment of the present invention) will be provided. FIG. 4 is an exploded perspective view schematically illustrating the structure of the display device 2*a* in which the light source device 3*a* is incorporated. In FIG. 4, the display device 2*a* and the light source device 3*a* are illustrated so that their front surfaces face toward the top of FIG. 4, and their back surfaces face toward the bottom of FIG. 4, based on which the descriptions will be provided.

The display device 2*a* according to the first preferred embodiment of the present invention includes the light source device 3*a*, a liquid crystal display module 28, a bezel 25, a control circuit board 26, and a control circuit board cover 27 arranged to cover the control circuit board 26.

The light source device 3*a* according to the first preferred embodiment of the present invention includes a chassis 33, the light source blocks 1, optical sheets 35 arranged to control the properties of the light emitted from the light source blocks 1, side holders 34 which define spacers for the optical sheets 35, and a frame 36 arranged to hold and securing the optical sheets 35 and other constituent elements to the chassis 33. In addition, the light source device 3*a* includes the photo-receiving mechanism 321 arranged to photo-receive the light emitted from the light source blocks 1, and a light source driving circuit board 37 which drives the light source block 1, and a light source driving circuit board cover 38 arranged to cover the light source driving circuit board 37.

Detailed descriptions of the above-described constituent elements will be provided. The chassis 33 is a member substantially in the shape of a square, which is preferably unitary molded by subjecting a metal plate material to press working. The chassis 33 has an undersurface substantially in the shape of a square, and sidewalls 331 provided on longer edges of the undersurface so as to extend toward the front surface of the display device 2*a*.

The light source blocks 1 include the color light-emitting diodes 12R, 12G and 12B which are arranged in a matrix on the substrates 11 substantially in the shape of a square. The detailed descriptions of the configuration of the light source blocks 1 are as already provided above. As the photo-receiving mechanism 321, a photo-receiving element such as a phototransistor and a photodiode as described above, or a circuit board incorporating such a photo-receiving element is preferably used.

The optical sheets 35 are members in the shape of a plate or sheet, or a set of the members, which are arranged to control the properties of the light emitted from the color light-emitting diodes 12R, 12G and 12B placed in the light source blocks 1. To be more specific, the optical sheets 35 define a stack of a diffusion plate, a lens sheet and a polarizing reflection film.

The side holders 34 are members substantially in the shape of a bar, which are preferably made of a resin material and unitary molded, and define the spacers on which the optical sheets 35 are placed.

The frame 36 is a member substantially in the shape of a square with an opening, which is preferably made of a metal plate material by preferably being subjected to press working, and holds and secures the light source blocks 1, the optical sheets 35 and other constituent elements to the chassis 33.

The light source driving circuit board 37 incorporates electronic circuits and electric circuits providing the light source block driving mechanism 31 and the correction mechanism 32.

The liquid crystal display module 28 is an assembly of the display panel 21, a circuit board which drives the display panel 21, and a film. The assembly generally has a configuration such that the circuit board on which the source drivers 22 and the gate drivers 23 are mounted and the film are attached to peripheral edges of the display panel 21 as shown in FIG. 4. For the display panel 21, a variety of known liquid crystal display panels such as an active matrix type liquid crystal display panel may be used. As the circuit board on which the source drivers 22 and the gate drivers 23 are mounted and the film, a known circuit board and a known film may be used.

The bezel 25 is a member substantially in the shape of a square with an opening, which is preferably made of a metal plate material by preferably being subjected to press working, and holds and secures the constituent elements including the liquid crystal display module 28 to the chassis 33.

The control circuit board 26 incorporates electronic circuits and electric circuits providing the display panel control mechanism 24 and other constituent elements.

The light source device 3*a* including the above-described constituent elements is assembled as follows. The light source blocks 1 are arranged in a matrix on a front surface of the chassis 33. The side holders 34 are placed on shorter edges of the chassis 33. On an inner surface of the side wall 331 of the chassis 33, the photo-receiving mechanism 321 is mounted (the state thereof will be described later). The optical sheets 35 are placed on the front surfaces of the chassis 33 and the side holders 34, and the frame 36 is further placed in front of the optical sheets 35 so as to be attached to the chassis 33. The light source driving circuit board 37 and the light source driving circuit board cover 38 are placed behind the chassis 33 and attached thereto.

The display device 2*a* is assembled as follows. The liquid crystal display module 28 is placed on a front surface of the frame 36 of the light source device 3*a*. The bezel 25 is further placed in front of the liquid crystal display module 28 and attached thereto. The control circuit board 26 and the control circuit board cover 27 are placed behind the light source device 3*a* and attached thereto.

Figure 5A:
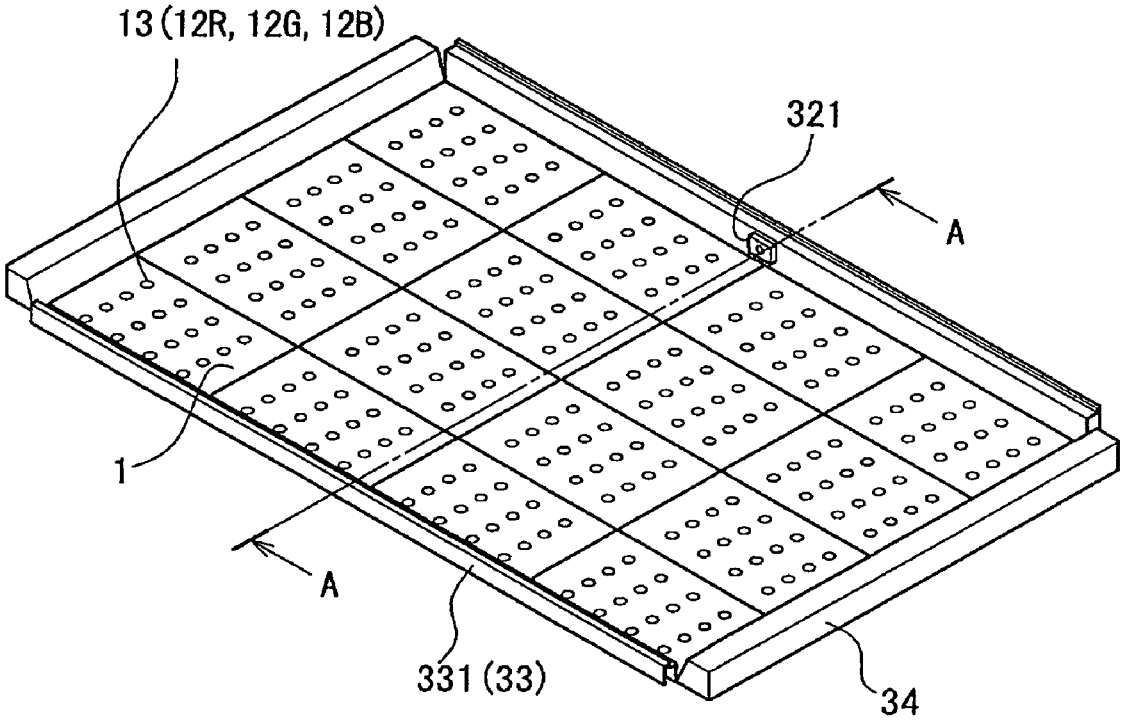
FIG. 5A is an external perspective view schematically illustrating a state where a chassis included in the light source device according to the first preferred embodiment of the present invention, the light source blocks, and a photo-receiving mechanism are assembled.
Figure 5B:
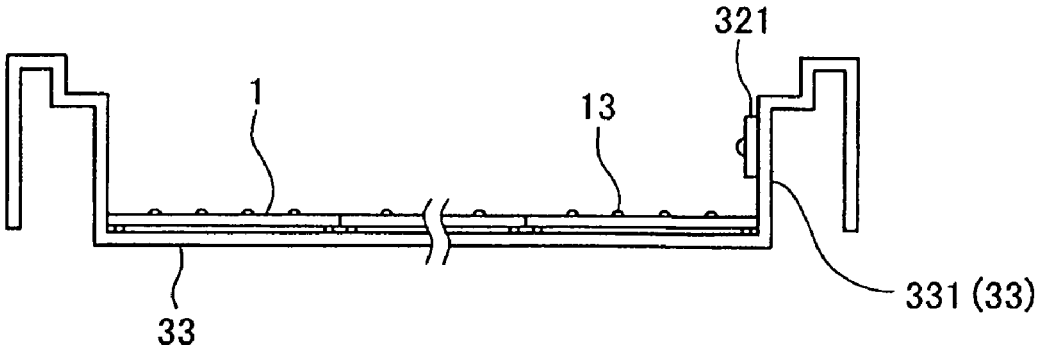
FIG. 5B is a cross-sectional view schematically illustrating the same along the line A-A of FIG. 5A.

FIG. 5A is an external perspective view schematically illustrating a state where the chassis 33, the light source blocks 1 and the photo-receiving mechanism 321 are assembled, and FIG. 5B is a cross-sectional view schematically illustrating the same along the line A-A of FIG. 5A. As shown in FIGS. 5A and 5B, the photo-receiving mechanism 321 is placed close to the upper edge of the side wall 331 of the chassis 33. This configuration enables one photo-receiving mechanism 321 to photo-receive the light emitted from the red-color light-emitting diodes 12R, the light emitted from the green-color light-emitting diodes 12G and the light emitted from the blue-color light-emitting diodes 12B in all of the light source blocks 1. In addition, the photo-receiving mechanism 321 having the configuration as above does not block the light from each of the light source blocks 1, which has no detrimental effect on the display quality.

However, since the photo-receiving mechanism 321 having the configuration as above has different distances from or different angles with respect to the light source blocks 1, it is necessary to take influences exerted by the differences in distance or angle between the photo-receiving mechanism 321 and the light source blocks 1 into consideration in order to calculate with accuracy the luminance of the red-color light-emitting diodes 12R, the luminance of the green-color light-emitting diodes 12G and the luminance of the blue-color light-emitting diodes 12B in each of the light source blocks 1 based on the photo-receiving amounts of the light photo-received by the photo-receiving mechanism 321. The variety of parameters required for the calculation are stored in the second storage mechanism 326 as described above.

Next, descriptions of a light source device and a display device according to a second preferred embodiment of the present invention are provided. Hereinafter, explanations of the same configurations as those in the first preferred embodiment of the present invention are omitted, and different respects are explained mainly, providing the same reference numerals as those in the first preferred embodiment of the present invention to the same structural components.

Figure 6:
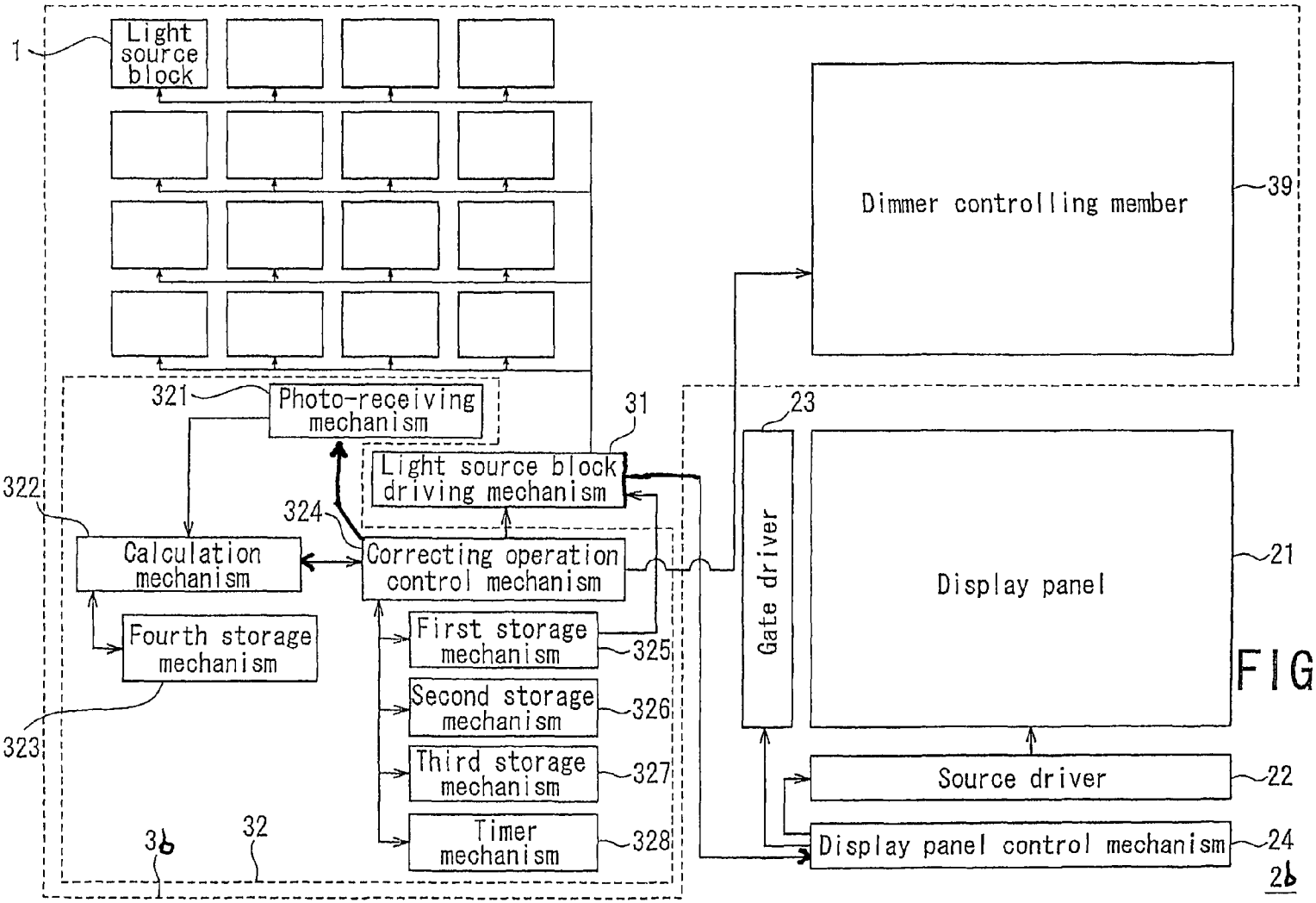
FIG. 6 is a block diagram schematically showing the configuration of a display device in which a light source device according to a second preferred embodiment of the present invention is incorporated.

FIG. 6 is a block diagram schematically showing the configuration of the light source device and the display device according to the second preferred embodiment of the present invention. A display device 2*b* according to the second preferred embodiment of the present invention includes a light source device 3*b* according to the second preferred embodiment of the present invention, the display panel 21 arranged to display an image, the source drivers 22 and the gate drivers 23 which drive the display panel 21, and the display panel control mechanism 24 arranged to control the source drivers 22 and the gate drivers 23.

The light source device 3*b* incorporated in the display device 2*b* includes the light source blocks 1, the light source block driving mechanism 31 arranged to drive the light source blocks 1, the correction mechanism 32 arranged to make and store correction data tables which are used for the correction of the luminance and/or the color tone within each of the light source blocks 1, and a dimmer controlling member 39 capable of controlling transmittance of light. The correction data tables are the same as those described in the first preferred embodiment of the present invention.

The correction mechanism 32 is the same as that described in the first preferred embodiment of the present invention, which accordingly includes the photo-receiving mechanism 321, the calculation mechanism 322, the fourth storage mechanism 323, the correcting operation control mechanism 324, the first storage mechanism 325, the second storage mechanism 326, the third storage mechanism 327, and the timer mechanism 328 as described in the first preferred embodiment of the present invention.

The correction mechanism 32, and the photo-receiving mechanism 321, the calculation mechanism 322, the fourth storage mechanism 323, the first storage mechanism 325, the second storage mechanism 326, the third storage mechanism 327 and the timer mechanism 328 which are included in the correction mechanism 32 are the same as those described in the first preferred embodiment of the present invention. Hence, explanations thereof are omitted.

The correcting operation control mechanism 324 controls the photo-receiving mechanism 321, the dimmer controlling member 39 and the calculation mechanism 322, and makes the correction data tables used for the correction of the luminance of the red-color light-emitting diodes 12R, the luminance of the green-color light-emitting diodes 12G and the luminance of the blue-color light-emitting diodes 12B in each of the light source blocks 1 based on the calculated photo-receiving amount ratios when the predetermined conditions are met as described in the first preferred embodiment of the present invention.

The dimmer controlling member 39 can control transmittance of the light, and is placed at a position on an optical path of the light between a point where the light is emitted from the light sources and a point where the light exits to the outside. To be more specific, a translucent display element such as a ferroelectric liquid crystal panel, a light shielding member having a shuttering mechanism which is capable of physically opening and closing, and other constituent elements may be preferably used for the dimmer controlling member 39.

As the ferroelectric liquid crystal panel used as the dimmer controlling member 39, a ferroelectric liquid crystal panel which has no pixel and is capable of controlling the transmittance of the light to be uniform over the entire screen of the panel may be preferably used. Such a ferroelectric liquid crystal panel maintains the highest transmittance of the light over the entire screen of the display panel 21 under a normal condition that the display panel 21 displays an image.

Figure 7:
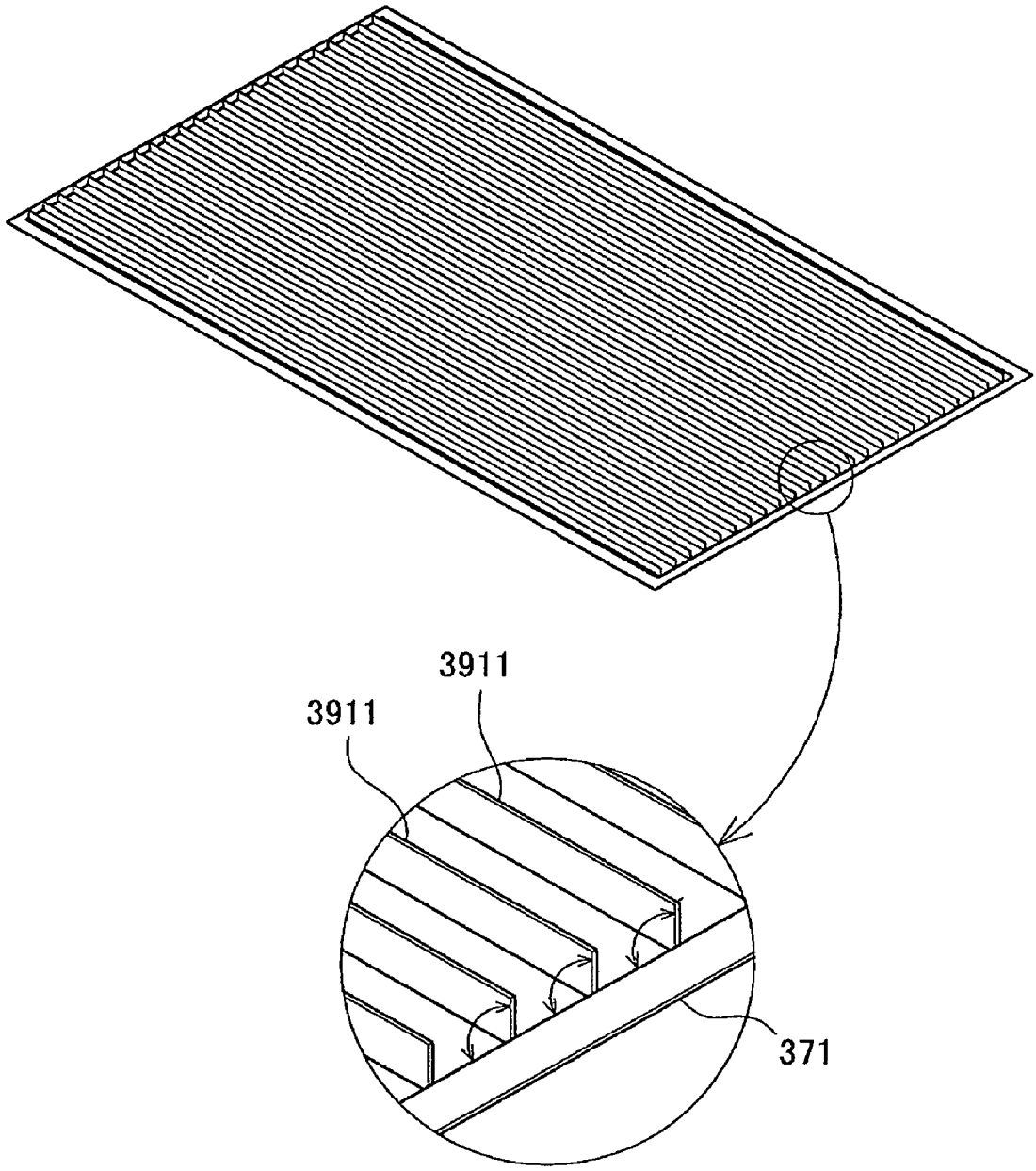
FIG. 7 is a perspective view schematically illustrating the configuration of a dimmer controlling member (light shielding member) which is used in the light source device according to the second preferred embodiment of the present invention.

FIG. 7 is a view showing an example of the configuration of the light shielding member having the shuttering mechanism which is capable of physically opening and closing. A light shielding member 391 shown in FIG. 7 includes blade-shaped members 3911, which are capable of opening and closing, and a support 371 for the blade-shaped members 3911. By making the blade-shaped members 3911 open and close, the transmittance of the light can be controlled. Under the normal condition, the blade-shaped members 3911 open so as to maintain the state of transmitting the light. For the light shielding member 391, a DMD (digital micromirror device) panel and other constituent elements may be preferably used.

Figure 8:
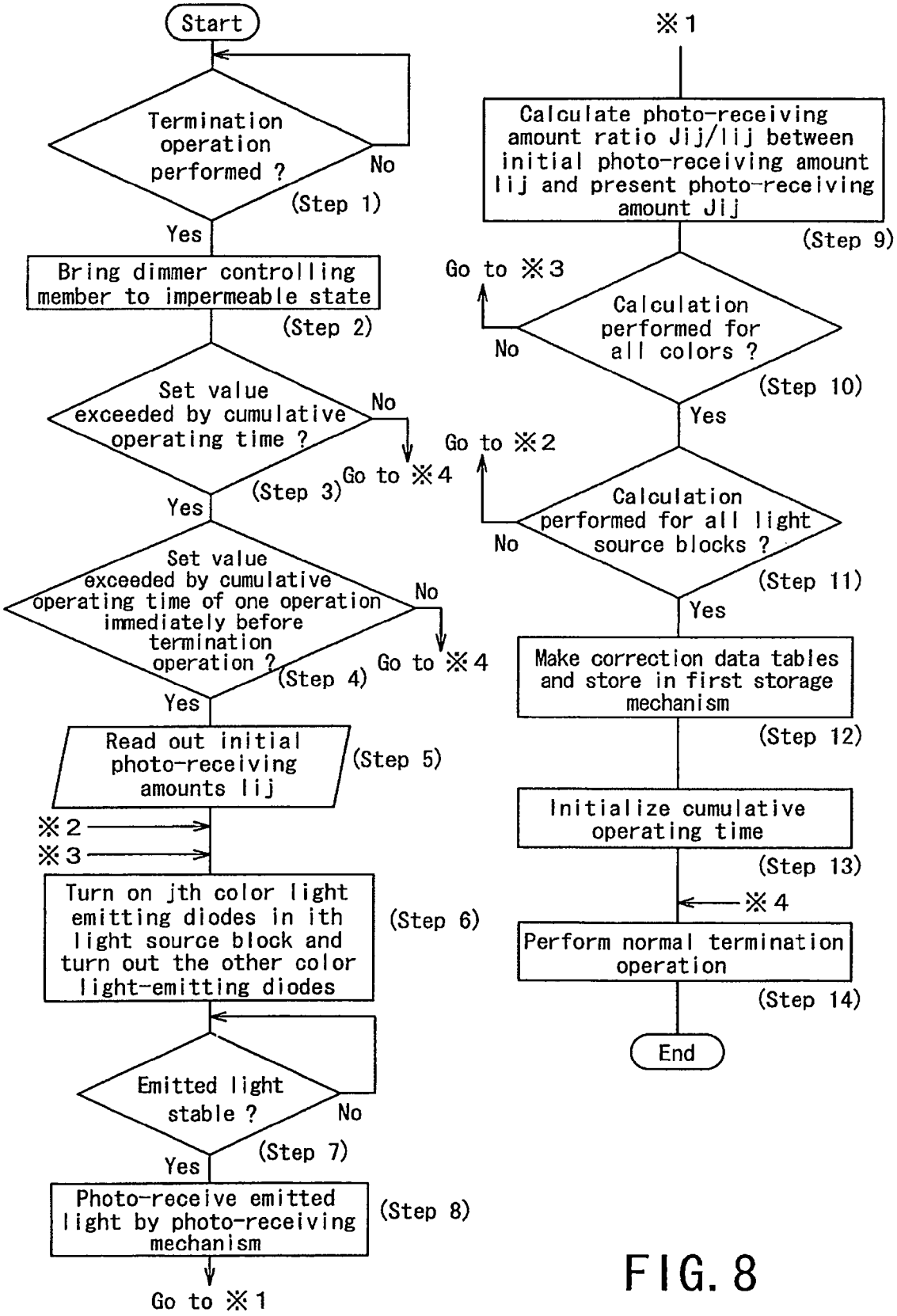
FIG. 8 is a flow chart showing the operation for correction of luminance and a color tone in the light source device according to the second preferred embodiment of the present invention which is incorporated in the display device.

Next, a description of the operation for the correction of the luminance and the color tone in the light source device 3*b* or the display device 2*b* having the above-described configuration, in other words, a description of a process of making the correction data tables, will be provided. FIG. 8 is a flow chart showing the process of making the correction data tables. Steps 3 to 14 are the same as those in the first preferred embodiment of the present invention, so that explanations thereof are omitted.

After a termination operation is performed in Step 1, the dimmer controlling member 39 is brought to an impermeable state (Step 2). The impermeable state defines a state where the luminance (or the transmittance) is substantially the lowest over the entire screen of the display panel 21 if the ferroelectric liquid crystal panel is used as the dimmer controlling member 39. Meanwhile, if the light shielding member 391 including the blade-shaped members 3911 is used as the dimmer controlling member 39, the impermeable state defines a state where the blade-shaped members 3911 close to shut the optical path and the transmittance of the light is made to be the lowest substantially.

After the dimmer controlling member 39 is brought to the impermeable state, the light from the color light-emitting diodes 12R, 12G and 12B in the light source blocks 1 can hardly pass through the dimmer controlling member 39. Accordingly, the user visually perceives the display in a state where the light source device 3*b* is turned out, or a similar state, regardless of the state of the display panel 21. While the display panel 21 is switched to be displayed in black in the first preferred embodiment of the present invention, the switch is not required in the second preferred embodiment of the present invention and the state of the display panel 21 does not count. Then, the process goes to Step 3 and the subsequent steps.

Also by this configuration, the same action and effect as the first preferred embodiment of the present invention can be produced. In other words, the measurement of the photo-receiving amounts of the light from the red-color light-emitting diodes 12R, the light from the green-color light-emitting diodes 12G and the light from the blue-color light-emitting diodes 12B in each of the light source blocks 1 is performed at the time when the display panel 21 does not need to display an image after the user performs the termination operation of the display device 2*b*. Accordingly, it is prevented that the user feels strangeness with the measurement operation for measuring the photo-receiving amounts. In addition, since the dimmer controlling member 39 is in the impermeable state while the measurement is performed, the user does not notice the measurement being performed regardless of the state of the display panel 21.

Figure 9:
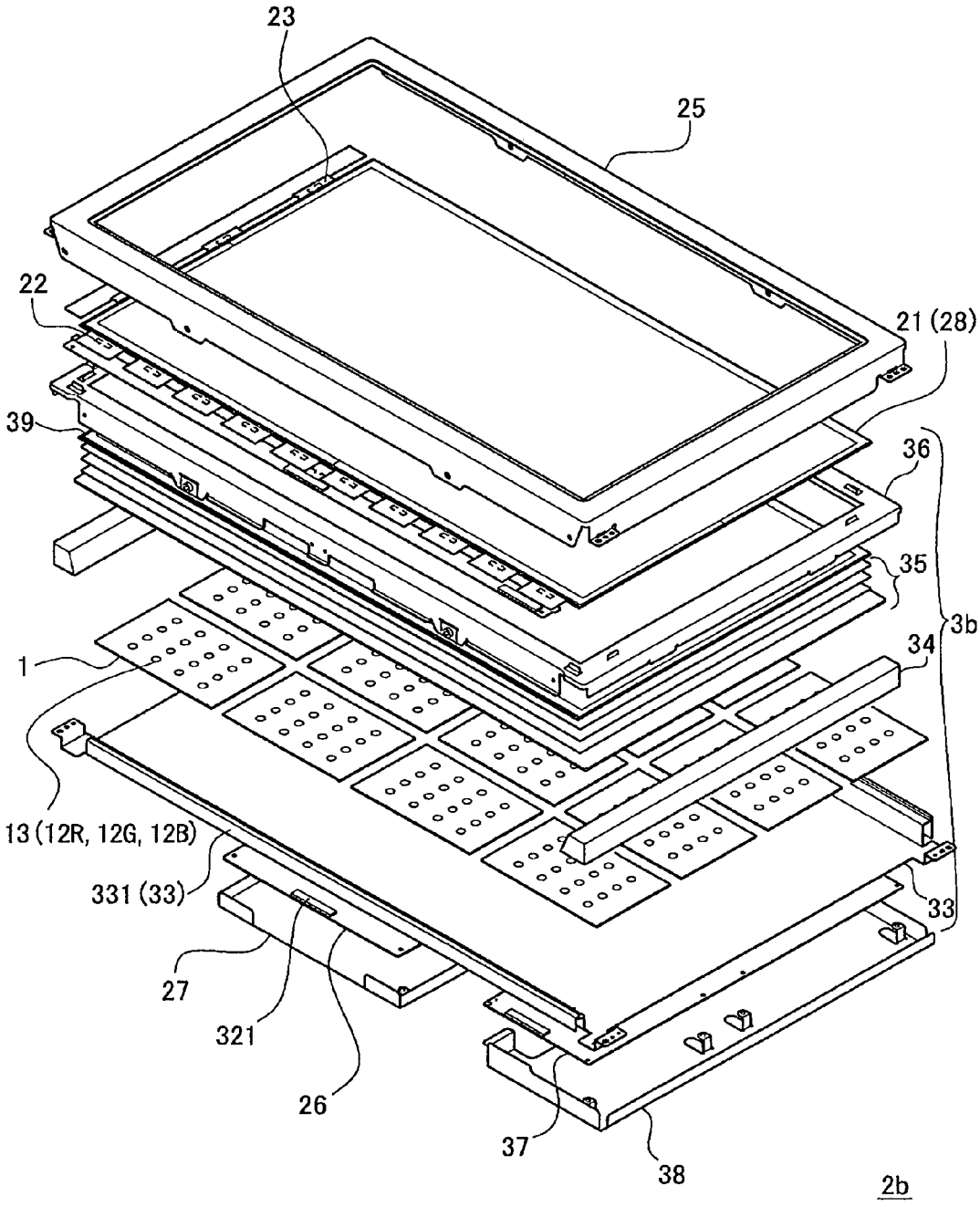
FIG. 9 is an exploded perspective view schematically illustrating the structure of the light source device according to the second preferred embodiment of the present invention and the display device.

Next, descriptions of the structure of the light source device 3*b* and the display device 2*b* according to the second preferred embodiment of the present invention will be provided. FIG. 9 is an exploded perspective view schematically illustrating the structure of the display device 2*b* in which the light source device 3*b* is incorporated. Hereinafter, explanations of the same configurations as the light source device 3*a* and the display device 2*a* according to the first preferred embodiment of the present invention are omitted, providing the same reference numerals thereto.

The display device 2*b* according to the second preferred embodiment of the present invention includes the light source device 3*b* according to the second preferred embodiment of the present invention, the liquid crystal display module 28, the bezel 25, the control circuit board 26, and the control circuit board cover 27 arranged to cover the control circuit board 26.

The light source device 3*b* according to the second preferred embodiment of the present invention includes the chassis 33, the light source blocks 1, the optical sheets 35 arranged to control the properties of the light emitted from the light source blocks 1, the dimmer controlling member 39 capable of controlling the transmittance of the light, the side holders 34 which define spacers for the optical sheets 35, and the frame 36 arranged to hold and secure the optical sheets 35 and other constituent elements to the chassis 33. In addition, the light source device 3*b* includes the photo-receiving mechanism 321 arranged to photo-receive the light emitted from the light source blocks 1, the light source driving circuit board 37 which drives the light source blocks 1, and the light source driving circuit board cover 38 arranged to cover the light source driving circuit board 37.

The light source device 3*b* including the above-described constituent elements is assembled as follows. The light source blocks 1 are arranged in a matrix on the front surface of the chassis 33. The side holders 34 are placed on the shorter edges of the chassis 33. On the inner surface of the sidewall 331 of the chassis 33, the photo-receiving mechanism 321 is mounted. The optical sheets 35 and the dimmer controlling member 39 are placed on the front surfaces of the chassis 33 and the side holders 34, and the frame 36 is further placed in front of the optical sheets 35 and the dimmer controlling member 39 so as to be attached to the chassis 33. The light source driving circuit board 37 and the light source driving circuit board cover 38 are placed behind the chassis 33 and attached thereto.

The display device 2*b* is assembled as follows. The liquid crystal display module 28 is placed on the front surface of the frame 36 of the light source device 3*b*. The bezel 25 is further placed in front of the liquid crystal display module 28 and attached thereto. The control circuit board 26 and the control circuit board cover 27 are placed behind the light source device 3*b* and attached thereto.

The position for placing the dimmer controlling member 39 is not limited to the above-described position. For example, it is also preferable for the dimmer controlling member 39 to be placed on the front surface of the frame 36. It is essential only that the dimmer controlling member 39 be placed at a position on the optical path of the light between the point where the light is emitted from the light source blocks 1 and the point where the light exits to the outside. Accordingly, the dimmer controlling member 39 may be placed not only in the light source device 3*b* as in the second preferred embodiment of the present invention, but also in a display device while using a light source device not including the dimmer controlling member 39 (e.g., the light source device 3*a* according to the first preferred embodiment of the present invention).

Figure 10:
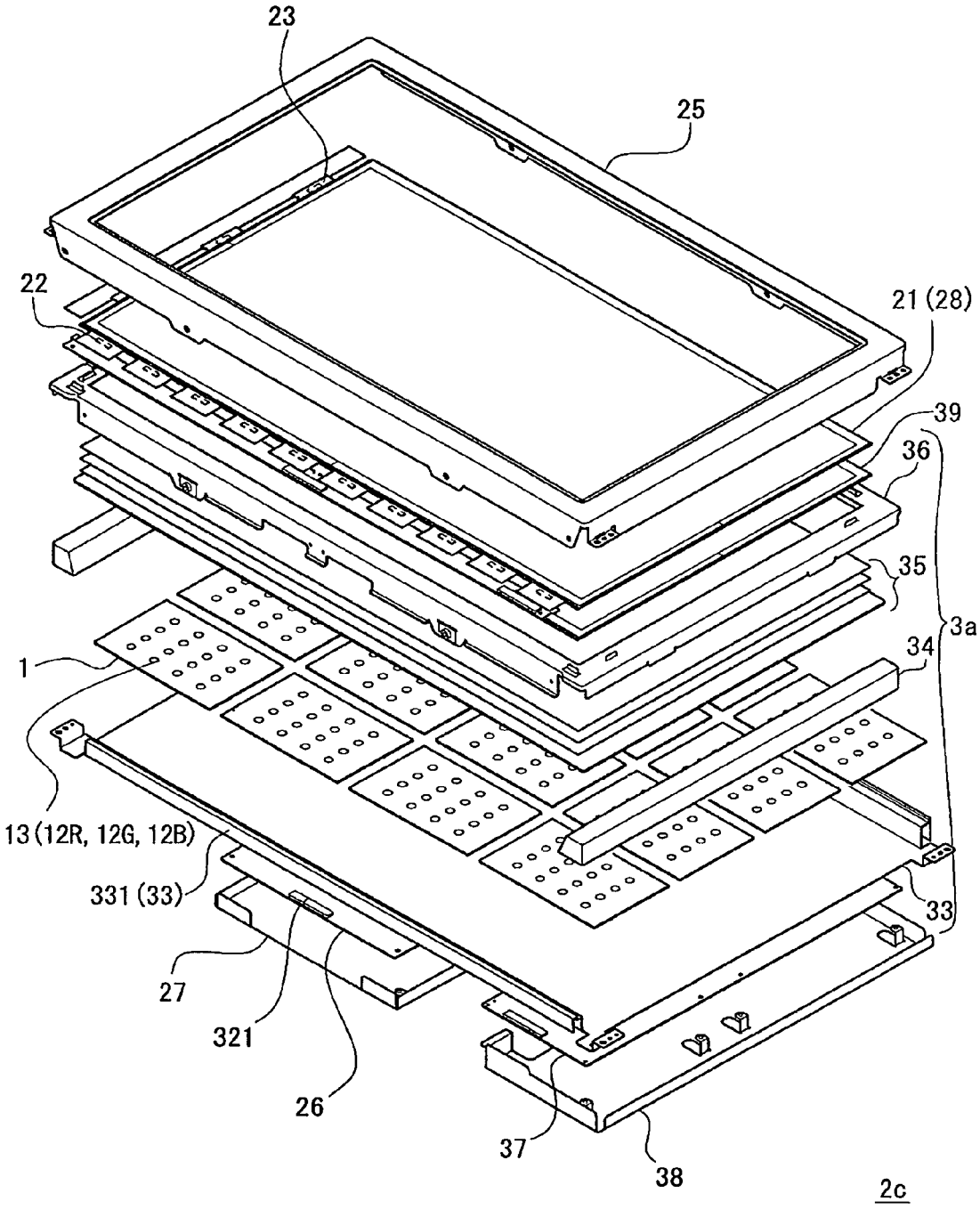
FIG. 10 is an exploded perspective view schematically illustrating the structure of the display device including the dimmer controlling member.

FIG. 10 is a view showing the structure of the display device including the dimmer controlling member. A display device 2*c* shown in FIG. 10 includes the light source device 3*a* according to the first preferred embodiment of the present invention (not including the dimmer controlling member 39), the dimmer controlling member 39, the display panel 21, and other predetermined constituent elements (almost the same constituent elements as those in the display device 2*a* according to the first preferred embodiment of the present invention). It is also preferable for the dimmer controlling member 39 to be placed on a back surface of the display panel 21 as shown in FIG. 10, and it is also preferable for the dimmer controlling member 39 to be placed on a front surface of the display panel 21. The operation of the display device 2*c* having the above-described configuration is almost the same as that of the display device 2*b* incorporating the light source device 3*b* according to the second preferred embodiment of the present invention, and an explanation thereof is omitted. Also by this configuration, the same action and effect as produced by the display device 2*b* according to the second preferred embodiment of the present invention can be produced.

Figure 11A:
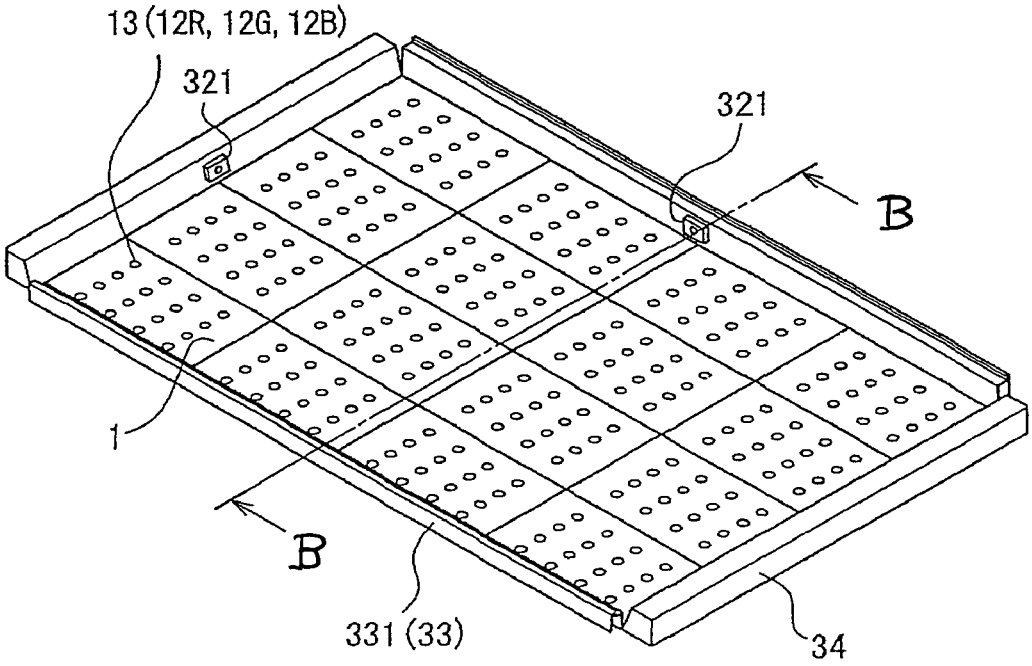
FIG. 11A is a perspective view schematically showing a modified example of the placement of the photo-receiving mechanism.
Figure 11B:
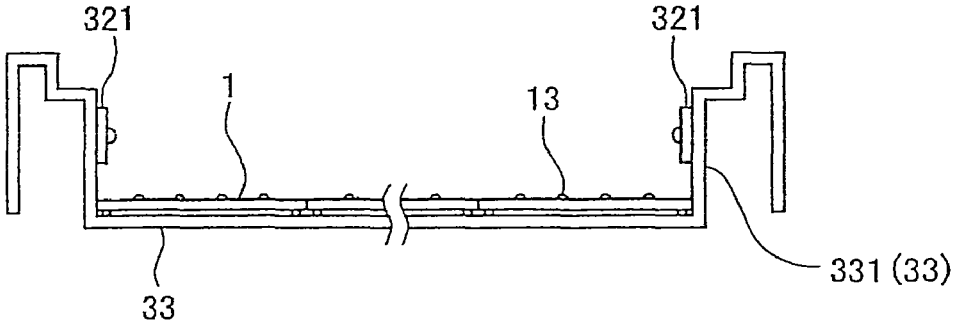
FIG. 11B is a cross-sectional view schematically illustrating the same along the line B-B of FIG. 11A.

The position for placing the photo-receiving mechanism 321 is not limited to the above-described position, and the number of photo-receiving mechanism 321 is not limited to one. FIG. 11A is a perspective view schematically showing a modified example of the placement of the photo-receiving mechanism 321, and FIG. 11B is a cross-sectional view schematically illustrating the same along the line B-B of FIG. 11A. As shown in FIGS. 11A and 11B, it is also preferable that a plurality of photo-receiving mechanisms 321 are provided to the side walls 331 of the chassis 33 and the side holders 34.

The plurality of photo-receiving mechanisms 321 may be arranged to concurrently photo-receive the light emitted from the red-color light-emitting diodes 12R, the light emitted from the green-color light-emitting diodes 12G and the light emitted from the blue-color light-emitting diodes 12B in each of the light source blocks 1. Alternatively, each of the photo-receiving mechanisms 321 may be arranged to separately photo-receive the light from an allocated group of the light source blocks 1.

It is also preferable that the photo-receiving mechanism 321 is provided to each of the light source blocks 1. By this configuration, the positional relationships between the photo-receiving mechanisms 321 and the light-emitting diodes, the photo-receiving amounts of the light emitted from which are to be measured, do not differ among the light source blocks 1, so that there is no need to take influences exerted by the differences in distance or angle between the photo-receiving mechanisms 321 and the light source blocks 1 into consideration when performing the measurement. Therefore, the second storage mechanism 326 does not need to store the parameters such as the differences in distance and angle between the photo-receiving mechanisms 321 and the light source blocks 1.

Incidentally, also by these configurations such that the plurality of photo-receiving mechanisms 321 are included, and that the photo-receiving mechanism 321 is provided to each of the light source blocks 1, the same action and effect as the above-described preferred embodiments of the present invention can be produced because a process of making the correction data tables is the same as the above-described preferred embodiments of the present invention.

Figure 12:
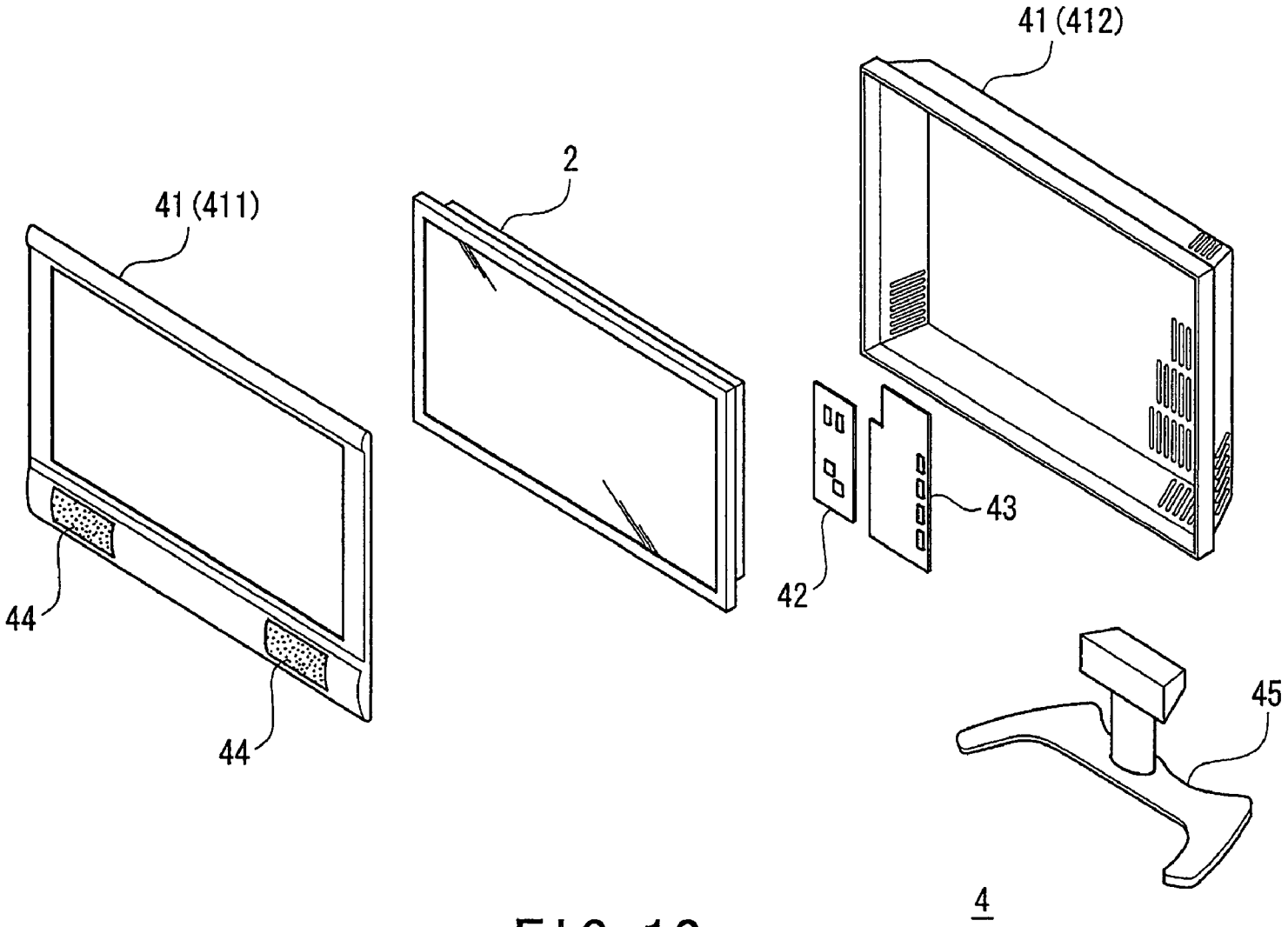
FIG. 12 is an exploded perspective view schematically illustrating the structure of a television receiver including the display device.
Figure 13:
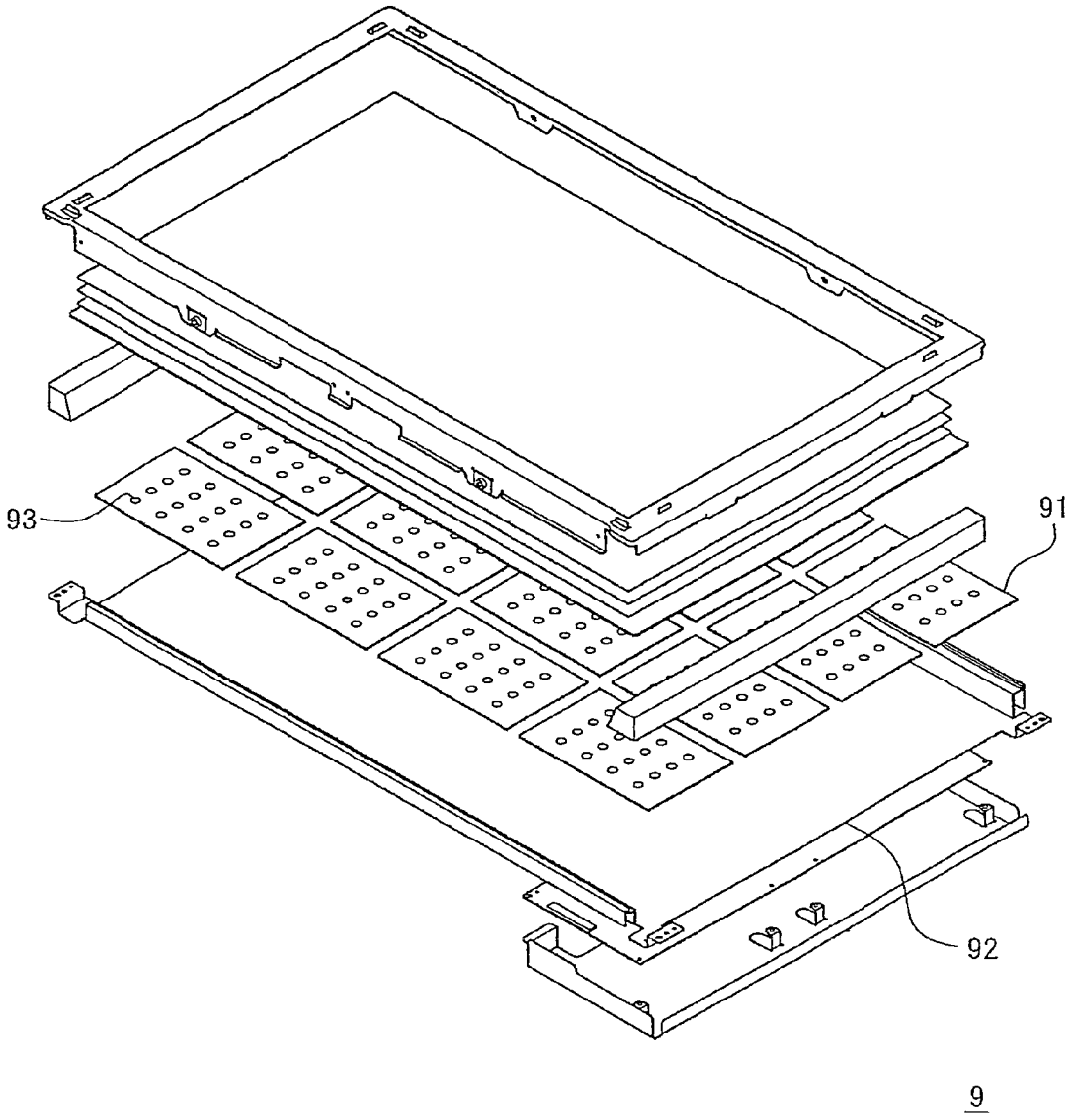
FIG. 13 is an exploded perspective view schematically illustrating the structure of a conventional light source device in which light-emitting diodes are incorporated.

Next, a description of a television receiver including the display device according to either one of the above-described preferred embodiments of the present invention will be provided. FIG. 12 is an exploded perspective view schematically illustrating the structure of the television receiver including the display device according to any of the above-described preferred embodiments of the present invention. A television receiver 4 shown in FIG. 12 includes a tuner 42 that produces an image signal and a sound signal of a given channel based on received radio waves or signals inputted from the outside, a display device 2 that displays an image based on the image signal produced by the tuner 42, loudspeaker mechanisms 44 that produce a sound based on the sound signal produced by the tuner 42, and an electric power supply board 43 that supplies electric power to the tuner 42, the display device 2 and the loudspeaker mechanisms 44.

As the tuner 42, a conventional terrestrial tuner (analog, digital, or both), a broadcasting satellite (BSI tuner, or a communication satellite (CS) tuner can be used. For the loudspeaker mechanisms 44, a variety of loudspeaker mechanisms such as a generally-used loudspeaker can be used. Hence, detailed descriptions thereof are omitted. As the display device 2, the display device according to either one of the above-described preferred embodiments of the present invention can be used.

As shown in FIG. 12, the display device 2, the tuner 42, the loudspeaker mechanisms 44 and the electric power supply board 43 are housed in a cabinet 41 (the cabinet 41 in FIG. 12 includes a front side cabinet 411 and a back side cabinet 412) which is supported by a stand 45.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A light source device, comprising:

a plurality of light source blocks, each of which has light sources arranged to emit light within different wavelength ranges which are adjusted independently;

a photo-receiving mechanism arranged to photo-receive the light emitted from the light sources of the light source blocks; and a correcting operation control mechanism;

wherein when a termination operation of the light source device is performed, the correcting operation control mechanism controls the light sources of the light source blocks to emit the light and the photo-receiving mechanism to photo-receive the emitted light, and based on photo-receiving amounts of the emitted light photo-received by the photo-receiving mechanism, calculates correction amounts of luminance of the light sources in each of the light source blocks, which are necessary to maintain at least one of luminance and a color tone to be uniform among the light source blocks.

2. A display device, comprising:

a display panel; and the light source device according to claim 1.

3. A television receiver, comprising:

the display device according to claim 2.

4. The light source device according to claim 1, further comprising:

a timer mechanism arranged to time an operating time of the light source device;

wherein when a cumulative operating time of the light source device exceeds a first preset time, the correcting operation control mechanism controls the light sources of the light source blocks to emit the light and the photo-receiving mechanism to photo-receive the emitted light, and based on the photo-receiving amounts of the emitted light photo-received by the photo-receiving mechanism, calculates the correction amounts of the luminance of the light sources in each of the light source blocks, which are necessary to maintain at least one of the luminance and the color tone to be uniform among the light source blocks.

5. The light source device according to claim 4, further comprising:

a dimmer controlling member capable of controlling transmittance of the emitted light, which is placed at a position on an optical path of the emitted light between a first point where the emitted light is emitted from the light sources and a second point where the emitted light exits the light source device;

wherein the dimmer controlling member is brought to an impermeable state during the calculation of the correction amounts of the luminance of the light sources in each of the light source blocks.

6. The light source device according to claim 5, wherein the dimmer controlling member is a translucent display element.

7. A display device, comprising:

a display panel; and the light source device according to claim 4.

8. A television receiver, comprising:

the display device according to claim 7.

9. A display device, comprising:

a display panel;

the light source device according to claim 4; and a dimmer controlling member placed at a position on an optical path of the emitted light between a first point where the emitted light is emitted from the light sources and a second point where the emitted light exits the light source device, which is brought to an impermeable state during the calculation of the correction amounts of the luminance of the light sources in each of the light source blocks.

10. A television receiver, comprising:

the display device according to claim 9.

11. The light source device according to claim 4, further comprising:

wherein when a continuous operating time of one operation of the light source device immediately before the termination operation of the light source device is performed exceeds a second preset time, the correcting operation control mechanism controls the light sources of the light source blocks to emit the light and the photo-receiving mechanism to photo-receive the emitted light, and based on the photo-receiving amounts of the emitted light photo-received by the photo-receiving mechanism, calculates the correction amounts of the luminance of the light sources in each of the light source blocks, which are necessary to maintain at least one of the luminance and the color tone to be uniform among the light source blocks.

12. The light source device according to claim 11, wherein the first preset time is equal to the second preset time.

13. The light source device according to claim 11, wherein the first preset time is longer than the second preset time.

14. The light source device according to claim 1, further comprising:

a timer mechanism arranged to time an operating time of the light source device;

wherein when a continuous operating time of one operation of the light source device immediately before the termination operation of the light source device is performed exceeds a preset time, the correcting operation control mechanism controls the light sources of the light source blocks to emit the light and the photo-receiving mechanism to photo-receive the emitted light, and based on the photo-receiving amounts of the emitted light photo-received by the photo-receiving mechanism, calculates the correction amounts of the luminance of the light sources in each of the light source blocks, which are necessary to maintain at least one of the luminance and the color tone to be uniform among the light source blocks.

15. The light source device according to claim 14, further comprising:

a dimmer controlling member capable of controlling transmittance of the emitted light, which is placed at a position on an optical path of the emitted light between a first point where the emitted light is emitted from the light sources and a second point where the emitted light exits the light source device;

wherein the dimmer controlling member is brought to an impermeable state during the calculation of the correction amounts of the luminance of the light sources in each of the light source blocks.

16. The light source device according to claim 15, wherein the dimmer controlling member is a translucent display element.

17. A display device, comprising:

a display panel; and the light source device according to claim 14.

18. A television receiver, comprising:

the display device according to claim 17.

19. A display device, comprising:

a display panel;

the light source device according to claim 14; and a dimmer controlling member placed at a position on an optical path of the emitted light between a first point where the emitted light is emitted from the light sources and a second point where the emitted light exits the light source device, which is brought to an impermeable state during the calculation of the correction amounts of the luminance of the light sources in each of the light source blocks.

20. A television receiver, comprising:

the display device according to claim 19.

* * * * *